US007794301B2

(12) United States Patent
Ostendorff et al.

(10) Patent No.: US 7,794,301 B2
(45) Date of Patent: Sep. 14, 2010

(54) TOY VEHICLE TRACKSET

(75) Inventors: Eric Ostendorff, Torrance, CA (US); Mike Nuttall, South Pasadena, CA (US)

(73) Assignee: Mattel, Inc., El Segundo, CA (US)

( * ) Notice: Subject to any disclaimer, the term of this patent is extended or adjusted under 35 U.S.C. 154(b) by 543 days.

(21) Appl. No.: 11/595,001

(22) Filed: Nov. 6, 2006

(65) Prior Publication Data

US 2007/0197127 A1 Aug. 23, 2007

Related U.S. Application Data

(60) Provisional application No. 60/734,509, filed on Nov. 7, 2005.

(51) Int. Cl.
*A63H 29/00* (2006.01)

(52) U.S. Cl. ..... 446/429; 446/433; 446/444; 104/55; 463/67; 238/10 R; 238/10 E

(58) Field of Classification Search ..... 446/429, 446/430, 433, 435, 444, 445, 448, 473; 463/58, 463/59, 67–69, 64; 238/10 E, 10 F, 10 R; 104/55, 53, 56, 57

See application file for complete search history.

(56) References Cited

U.S. PATENT DOCUMENTS

| | | | | |
|---|---|---|---|---|
| 972,724 | A | 10/1910 | Smith | |
| 2,522,160 | A | 9/1950 | Borchers | |
| 2,756,687 | A | 7/1956 | Fields | |
| 3,209,491 | A | 10/1965 | Roeper | |
| 3,411,783 | A * | 11/1968 | Montagna | 238/10 F |
| 3,562,949 | A | 2/1971 | Beny et al. | |
| 3,585,751 | A | 6/1971 | Beny et al. | |
| 3,590,524 | A * | 7/1971 | Beny et al. | 446/429 |
| 3,599,365 | A | 8/1971 | Carver et al. | |

(Continued)

FOREIGN PATENT DOCUMENTS

| | | | |
|---|---|---|---|
| GB | 2103949 | A | 3/1983 |

(Continued)

*Primary Examiner*—Gene Kim
*Assistant Examiner*—Scott Young
(74) *Attorney, Agent, or Firm*—Edell, Shapiro & Finnan LLC

(57) ABSTRACT

A toy vehicle trackset utilizes a pair of closed track loops each having a lower end and a raised end. The raised ends of the loops are supported by a raised support having a spring-loaded dinosaur launcher within which a flying dinosaur is supported. A target is coupled to the launcher and positioned in alignment with a pair of launch ramps extending from each of the pathways through a center lap counter which is shaped to simulate a volcano. Within the lap counter, a diverter is supported to switch a moving toy vehicle from its normal loop path to the target directed ramp once the toy vehicle has completed a predetermined number of laps upon the loop by one player. A dual loop hand-operated toy vehicle booster is supported at the lower end return path of each of the loops. The child user is able to crank a hand crank to initiate a manual boost of a toy vehicle. Proper timing of the hand crank is essential to impart maximum boost to a toy vehicle and impart rapid vehicle movement.

20 Claims, 3 Drawing Sheets

U.S. PATENT DOCUMENTS 3,600,849 A * 8/1971 Faller ..... 446/429
3,600,850 A 8/1971 Summerfield
3,603,024 A * 9/1971 Davis et al. ..... 446/65
3,641,704 A * 2/1972 Sims et al. ..... 446/429
3,712,615 A * 1/1973 Staats et al. ..... 463/59
3,733,742 A 5/1973 Terzian
3,762,095 A * 10/1973 Merino et al. ..... 446/430
3,860,237 A 1/1975 Cooper et al.
3,877,169 A 4/1975 Munday et al.
3,886,682 A 6/1975 Ieda et al.
3,908,303 A 9/1975 McKay et al.
3,998,460 A * 12/1976 Dyer ..... 463/64
4,146,991 A 4/1979 Sano
4,203,247 A * 5/1980 Moe et al. ..... 446/429
4,394,961 A 7/1983 Müller
4,475,303 A 10/1984 Ribas et al.
4,504,242 A * 3/1985 Crain et al. ..... 446/429
4,519,789 A * 5/1985 Halford et al. ..... 446/444
D281,442 S 11/1985 Takeuchi
4,558,867 A * 12/1985 Hippely ..... 273/412
4,564,197 A * 1/1986 Lambert et al. ..... 463/64
4,642,066 A 2/1987 Kennedy et al.
4,799,916 A 1/1989 McKay et al.
4,925,188 A * 5/1990 McKay et al. ..... 463/59
5,234,216 A * 8/1993 Ostendorff ..... 273/127 A
5,299,969 A * 4/1994 Zaruba ..... 446/429
5,370,571 A 12/1994 Bosch
5,542,668 A * 8/1996 Casale et al. ..... 463/59
5,586,923 A 12/1996 Hippely et al.
5,655,943 A 8/1997 Dahlgren
5,899,789 A * 5/1999 Rehkemper et al. ..... 446/444
6,089,951 A * 7/2000 Ostendorff ..... 446/429
6,179,680 B1 * 1/2001 Hornsby et al. ..... 446/65
6,241,573 B1 * 6/2001 Ostendorff et al. ..... 446/444
6,358,112 B1 3/2002 Lambert
6,361,393 B1 * 3/2002 Seymour ..... 446/34
6,676,480 B2 1/2004 Sheltman
6,695,675 B1 * 2/2004 Ngan ..... 446/429
6,793,554 B1 * 9/2004 Newbold ..... 446/429
6,913,508 B2 * 7/2005 Hornsby et al. ..... 446/438
7,387,559 B2 * 6/2008 Sanchez-Castro et al. ... 446/444
2004/0198166 A1 10/2004 Newbold
2005/0191938 A1 9/2005 Sheltman et al.
2005/0287915 A1 12/2005 Sheltman et al.

FOREIGN PATENT DOCUMENTS

WO WO 99/49948 10/1999

* cited by examiner

TOY VEHICLE TRACKSET

CROSS-REFERENCE TO RELATED APPLICATIONS

This application claims the benefit of and priority under 35U.S.C. 119(e) of U.S. Provisional Patent Application Ser. No. 60/734,509 entitled Toy Vehicle Trackset filed Nov. 7, 2005 in the names of Eric Ostendorff and Mike Nuttal, the disclosure of which is incorporated herein by reference.

FIELD OF THE INVENTION

This invention relates generally to toy vehicles and particularly to the trackset apparatus used therewith.

BACKGROUND OF THE INVENTION

Toy vehicles have proven to be an extremely popular and long-lasting toy product. In response to this extended popularity, practitioners in the art have endeavored to increase the appeal of toy vehicles to consumers by designing and creating a variety of innovative toy vehicle tracksets.

Many innovative tracksets for toy vehicles which have been produced by practitioners in the toy art have enhanced their play value by employing apparatus which might be generally described as stunt devices. Stunt devices are characterized generally in that they operate in combination with a toy vehicle trackset and typically provide some play element which is activated by the proximity or passage of a toy vehicle through a stunt device. Additionally, stunt devices have been provided which respond to other activities of toy vehicles on the trackway such as collisions or impact upon a target or the like. For example, U.S. Pat. No. 6,358,112 issued to Lambert et al. sets forth a TOY VEHICLE TRACKWAY SET HAVING VEHICLE SNATCHING TOY FIGURE in which a toy vehicle trackway defines a loop together with means for launching and propelling one or more toy vehicles through the loop portion of the trackway. Within the loop, a toy figure is supported and includes a figure head which is pivotable between a first stable position in which toy vehicles are able to avoid the figure head and a second position in which toy vehicles are captured by the figure head and removed from the track. The toy figure head is moved from the stable position to the capture position in response to impact or energy vibrations set up within the loop structure.

U.S. Pat. No. 6,241,573 issued to Ostendorffet al. sets forth a TOY VEHICLE TRACKSET HAVING PLURAL INTERSECTIONS in which a continuous toy vehicle track is provided with a rotating wheel booster station together with a sharply angled vertical ramp. The upper end of the vertical ramp terminates in a loop which directs the rising toy vehicle downwardly into a descending spiral ramp after which the toy vehicle is returned to the booster. The descending spiral ramp intersects the upwardly angled vertical track segment in several places creating the possibility of collision between a descending toy vehicle and a rising toy vehicle.

U.S. Pat. No. 6,676,480 issued to Sheltman sets forth a STAGING MECHANISM FOR TOY VEHICLE PLAYSET in which a continuous loop toy vehicle track supports a booster and a plurality of toy vehicles. The trackset is formed of spaced-apart track rails forming a gap there between. The toy vehicles are open wheeled and able to roll upon the track rails in either a right side up or inverted configuration. In the inverted configuration, the top surface of the toy vehicle is able to extend into the gap between the track rails. A staging lane facilitates introduction of additional toy vehicles to the trackset.

U.S. Pat. No. 6,089,951 issued to Ostendorff sets forth a TOY VEHICLE AND TRACKSET HAVING LAP-COUNTING FEATURE in which a closed loop trackset is provided with a rotating wheel booster for accelerating toy vehicles upon the track. The toy vehicles support momentum sensitive switches and microprocessor based counters together with a liquid crystal display for responding to each disturbance of the momentum switch to increment the display lap count upon the liquid crystal display. The momentum switch is positioned and configured to respond to the momentum changes imparted to the toy vehicle as the booster accelerates the toy vehicle.

Published U.S. Patent Application 2005/0191938 filed on behalf of Sheltman et al. and entitled GRAVITY LAUNCHER AND CLAMP FOR TRACKSET sets forth a toy vehicle launcher and supporting clamp used in providing a gravity driven toy vehicle trackset. The clamp utilizes a ratcheting attachment member which facilitates the rapid sizing or adjustment for size enabling quick attachment to a table edge or the like. The launcher and clamp further provides a toy vehicle launcher having a trigger release for gravity driven launch of a toy vehicle down a track coupled to the launcher. The angle of the toy vehicle launcher is adjustable to facilitate changes in the launch angle and thereby facilitate changes in the amount of energy imparted to the launched toy vehicle.

International Application published under the patent cooperation treaty No. WO/99/49948 filed on behalf of Lambert and entitled TOY VEHICLE JUMPSET WITH CROSSING RISE AND DESCENT PATHS sets forth a closed loop trackway having a rotating wheel booster operative thereon. The trackway further defines an upwardly directed jump ramp which causes an accelerated toy vehicle to be directed upwardly across a vertical jump and thereafter be received in a loop which redirects the toy vehicle downwardly to a descending jump ramp. The upwardly directed and descending jump paths cross each other and create the possibility of a collision between ascending and descending toy vehicles.

In another type of apparatus employed by practitioners in the art to enhance the appeal and enjoyment of toy vehicle tracksets, a loop feature is often provided. Such loop features may be generally characterized as track portions which intercept a moving toy vehicle and travel it through the pathway of a loop feature and thereafter return the toy vehicle to the trackway for continued travel. Often within the loop feature, additional stunt activity such as redirection or capture is provided. For example, U.S. Pat. No. 5,299,969 issued to Zaruba sets forth a LOOP FEATURE FOR PROPELLED TOY VEHICLES having a generally vertically oriented single loop which in turn includes a moveable ingress portion and a moveable egress portion. A propelled toy vehicle enters the loop upon engaging one surface of the ingress portion. Player operated controls effect movement of the egress portion to permit or prohibit the propelled toy vehicle from exiting the loop.

U.S. Pat. No. 4,146,991 issued to Sano sets forth a TOY TRACKWAY having a pair of generally straight toy vehicle track segments coupled to a double connecting and direction reversing loop at one end. The remaining end of one segment is coupled to a toy vehicle launcher while the remaining end of the other segment is coupled to a finish line. A toy vehicle is propelled from the launcher down one straight track segment and is reversed through the double reverse loop and redirected in a return path upon the parallel track segment.

U.S. Pat. No. 4,394,961 issued to Muller sets forth a TRACK FOR TOY VEHICLES WITH JUMPING-OFF AND JUMPING-ON RAMPS in which a trackway includes oppositely directed curved ramp portions positioned upon a trackway to intercept and redirect a traveling toy vehicle. One ramp intercepts the toy vehicle and directs it upwardly reversing its direction and sending the toy vehicle away from the first loop in a free flight travel path. The second loop is positioned within the anticipated flight path of the toy vehicle and captures the toy vehicle returning it to the trackway.

U.S. Pat. No. 5,586,923 issued to Hippely et al. sets forth a TOY VEHICLE PLAYSET FOR THERMOCHROMIC VEHICLES having a toy vehicle launcher coupled to a straight track segment which in turn is coupled to a vertical loop segment. At the end of the vertical loop segment, a container of water at a suitable temperature is positioned to receive the toy vehicle. As the toy vehicle descends into the water, the thermochromic material of the toy vehicle is activated changing the vehicles appearance. A robot arm is operative to remove the toy vehicle from the liquid and place it upon a return path.

Published U.S. Patent Application 2005/028795 filed on behalf of Sheltman et al. sets forth a STUNT DEVICE FOR TOY VEHICLE TRACKSET having a continuous trackway which includes a rotating wheel booster for accelerating toy vehicles. In one portion of the trackway, an ascending ramp is directed upwardly to a vertical loop through an intersection gap in the trackway. The vertical loop provides an inverting travel path which receives the toy vehicle traversing the gap in the upwardly directed loop and redirects is downwardly in a descending path across a second gap to a descending return ramp. The ascending and descending travel paths extend through respective gaps which are coincident forming an intersection. As toy vehicles traverse the ascending and descending travel paths through the intersection, collision often occur as part of the anticipated play pattern.

In a related area of the toy art, practitioners often produce various types of devices which are generally described as launching devices. Such devices are generally characterized as being capable of accelerating a vehicle from a standing stop in the launch device to a high speed travel down a trackway or the like. For example, U.S. Pat. No. 5,370,571 issued to Bosch sets forth a TOY PROJECTILE LAUNCHING DEVICE which includes surface suitably configured to support and guide a projectile. A lever pivotally mounted so as to traverse a portion of the surface in the direction the projectile is being guided imparts energy to the projectile as it travels across the surface.

U.S. Pat. No. 4,642,066 issued to Kennedy et al. sets forth a TOY VEHICLE LAUNCHER AND SOUND GENERATOR which utilizes a launching mechanism operative in combination with a rotatably mounted hexagonal toy vehicle magazine. The toy vehicle magazine supports a plurality of toy vehicles. As the launcher is activated to impart energy to a toy vehicle, the restaging of the launcher rotates the magazine positioning the next toy vehicle for launch.

U.S. Pat. No. 4,504,242 issued to Crain et al. sets forth a MODULAR UNIT WITH TOY VEHICLE PROPULSION DEVICE in which a launcher device defines a launching station upon which a to-be-launched toy vehicle is positioned. A launcher arm is pivotally moveable between a retracted position and an impact position at high speed in response to the mechanical energy applied by the user. The mechanical energy is translated from the user to movement of the arm by a helical travel device coupling.

U.S. Pat. No. 4,475,303 issued to Ribas et al. sets forth a PAD FOR LAUNCHING TOY VEHICLES ONTO A TRACK while U.S. Pat. No. 4,203,247 issued to Moe et al. sets forth a TOY VEHICLE LAUNCHER AND TOY VEHICLE FOR USE THEREWITH both of which may be characterized as launchers which impart energy to a toy vehicle by a pivoting arm.

Published U.S. Patent Application 2004/0198166 filed on behalf of Newbold sets forth a FLEXIBLE WALL BOOSTER WHEEL FOR TOY VEHICLE TRACKSET while U.S. Pat. No. Des. 281,442 issued to Takeuchi sets forth a DEVICE FOR PROPELLING TOY CARS both of which provide general examples of additional toy vehicle launchers generally related to the present invention.

U.S. Pat. No. 4,925,188 issued to McKay et al.; U.S. Pat. No. 3,860,237 issued to Cooper et al. and U.S. Pat. No. 4,564,197 issued to Lambert et al. set forth examples of toy vehicle tracksets having multiple trackways suitable for race type activities.

U.S. Pat. No. 972,724 issued to Smith; U.S. Pat. No. 2,522,160 issued to Borchers; U.S. Pat. No. 2,756,687 issued to Fields; U.S. Pat. No. 3,209,491 issued to Roeper; U.S. Pat. No. 3,562,949 issued to Beny et al; U.S. Pat. No. 3,585,751 also issued to Beny; U.S. Pat. No. 3,599,365 issued to Carver; U.S. Pat. No. 3,600,849 issued to Faller; U.S. Pat. No. 3,600,850 issued to Summerfield; U.S. Pat. No. 3,733,742 issued to Terzian; U.S. Pat. No. 3,877,169 issued to Munday et al.; U.S. Pat. No. 3,908,303 issued to McKay et al.; U.S. Pat. No. 3,998,460 issued to Dyer and British Application U.S. Pat. No. 2,103,949 filed on behalf of Matsumoto et al. Each set forth of examples of early attempts by practitioners in art to provide more amusing and entertaining toy vehicle tracksets.

Finally, U.S. Pat. No. 5,899,789 issued to Rehkemper et al.; U.S. Pat. No. 4,799,916 issued to McKay et al.; U.S. Pat. No. 3,886,682 issued to Leda et al.; U.S. Pat. No. 3,712,615 issued to Staats et al. and U.S. Pat. No. 5,655,943 issued to Dahlgren set forth miscellaneous apparatus developed by practitioners in the art which is somewhat related to the present invention environment.

While the foregoing described prior art devices have to some extent improved the art and have in some instances enjoyed commercial success, there remains nonetheless a continuing need in the art for evermore amusing, entertaining and interesting toy vehicle tracksets.

SUMMARY OF THE INVENTION

Accordingly, it is a general object of the present invention to provide an improved toy vehicle trackset. It is a more particular object of the present invention to provide an improved toy vehicle trackset which utilizes an interesting and novel stunt and target apparatus in combination therewith.

In accordance with the present invention there is provided a toy vehicle trackset includes a raised end portion supporting one end of a pair of track loops. The remaining ends of each track loop are rested upon a floor surface. In the middle portion of the track loops, a lap counter and stunt device simulating a volcano is supported. Each of the track loops pass through the lap counter when traveling from the raised end support to the lower end resting on the play surface. Between the lap counter and the lower ends of the track loops, a dual side by side pair of loop boosters which are manually operated by the child user are situated to accelerate the toy vehicles on each track loop toward the high end of the trackset. At the upper end of the raised support, a simulated prehistoric bird is situated in a spring-loaded launcher. A target hangs downwardly within the trackset path so as to be impactable by a properly directed toy vehicle. When the target is impacted, the player wins the game as the flying dinosaur is launched.

From a somewhat different perspective, the present invention provides a toy vehicle trackset comprising: a raised track support; a pair of closed toy vehicle track loops each having a raised end supported by the raised track support and a lower end; a dual loop booster having a pair of booster loops each having a portion of one of the track loops passing therethrough and each operative to accelerate a toy vehicle passing through the booster loop; a lap counter, interposed between the raised track support and the dual loop booster, having a pair of open-end launch ramps and means for diverting a toy vehicle from one of the track loops to one of the launch ramps; and a target positioned in the path of toy vehicle launched from either of the launch ramps.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENT

By way of overview, the present invention toy vehicle trackset utilizes a pair of closed track loops each having a lower end and a raised end. The raised ends of the loops are supported by a raised support having a spring-loaded dinosaur launcher within which a flying dinosaur is supported. A target is coupled to the launcher and positioned in alignment with a pair of launch ramps extending from each of the pathways through a center lap counter which is shaped to simulate a volcano. Within the lap counter, a diverter is supported to switch a moving toy vehicle from its normal loop path to the target directed ramp once the toy vehicle has completed a predetermined number of laps upon the loop by one player. A dual loop hand-operated toy vehicle booster is supported at the lower end return path of each of the loops. The child user is able to crank a hand crank to initiate a manual boost of a toy vehicle. Proper timing of the hand crank is essential to impart maximum boost to a toy vehicle and impart rapid vehicle movement.

Figure 1:
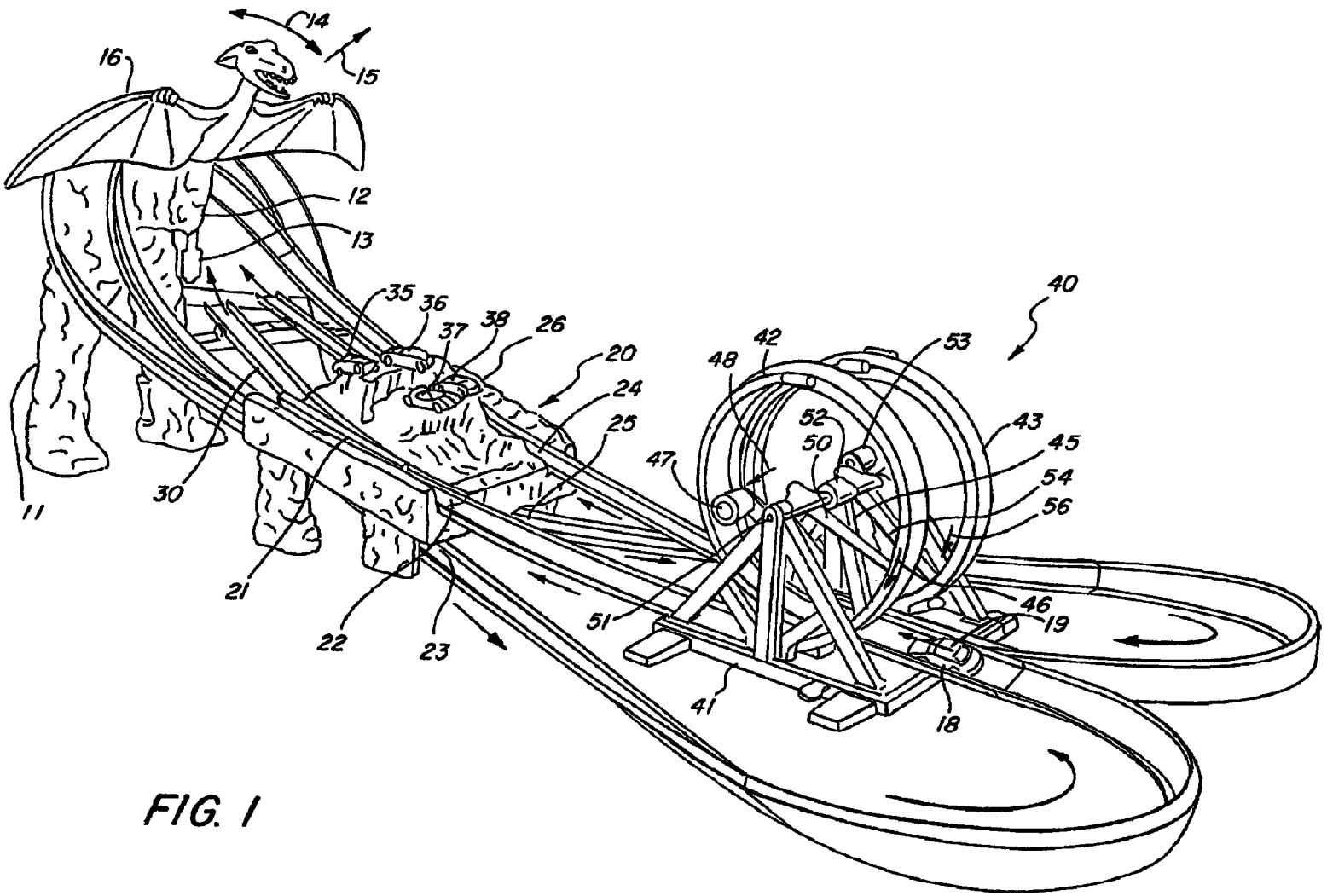
FIG. 1 sets forth a perspective view of a toy vehicle trackset constructed in accordance with the present invention having a volcano lap counter, a flying dinosaur target and a dual loop hand-operated booster.

More specifically, FIG. 1 sets forth a perspective view of a toy vehicle trackset constructed in accordance with the present invention and generally referenced by numeral 10. Toy vehicle trackset 10 includes a raised support 11 which in turn receives and supports a flying dinosaur 16 supported within a spring-loaded launcher 12. Launcher 12 includes a trigger release 13 extending downwardly from launcher 12. Trackset 10 further includes a closed track loop 27 which passes around raised support 11 and returns to a lower position upon the play surface. Similarly, track loop 28 forms a closed loop and extends upwardly about raised support 11 and downwardly to a lower end resting on the play surface.

Toy vehicle playset 10 further includes a lap counter 20 through which track loops 27 and 28 pass and a dual loop booster 40 which is situated upon the return paths of track loops 27 and 28. Lap counter 20 may be constructed in accordance with conventional fabrication techniques. Lap counter 20 operates diverter 21 once a given number of laps have been completed.

In the anticipated play pattern of the present invention, a toy vehicle traveling upon a track loop such as toy vehicle 18 traveling upon track loop 27 reaches loop 42 of dual loop booster 40. By means described below in greater detail, the child user employs dual loop booster 40 to accelerate toy vehicle 18 upwardly along the rising path of track loop 27. The toy vehicle passes through lap counter 20 along a path 22. The vehicle then ascends to the high point of the track loop supported upon raised support 11 and thereafter travels downwardly upon a return path 23 through lap counter 20. This process continues as the child user accelerates the toy vehicle by employing dual loop booster 40. The basic object is, of course, to properly time the operation of booster 40 to maximize the vehicle acceleration. The operation of track loop 28 is generally the same as track loop 27.

Figure 2:
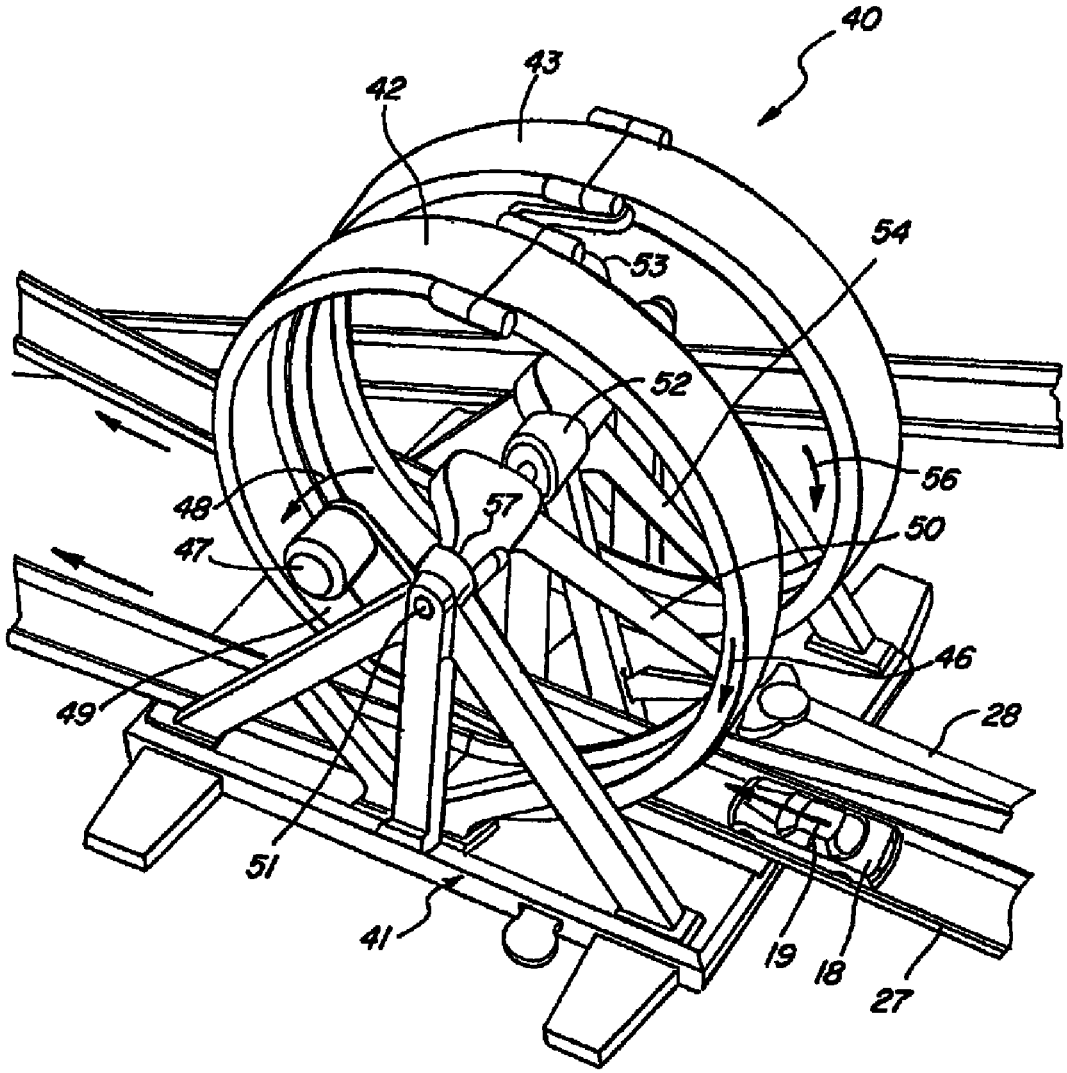
FIG. 2 sets forth a perspective view of the dual loop hand-operated booster of the present invention toy vehicle trackset.

With concurrent reference to FIGS. 1 and 2, dual loop booster 40 includes a pair of side by side redundant booster loops 42 and 43 which are mirror images of each other and identical in operation. Thus, the operation of accelerating toy vehicle 18 through loop 42 of booster 40 described below will be understood to apply equally well to accelerating a toy vehicle through loop 43 of booster 40 upon track loop 28.

More specifically, dual loop booster 40 includes the above-mentioned side by side mirror image loops 42 and 43. A base 41 supports loops 42 and 43 in their side by side configuration. Track loop 27 passes into loop 42 and outwardly from loop 42 as it rises toward lap counter 20. Base 41 supports a shaft 51 having an end gear thereon which engages a sector gear 49 rotatably supported upon one side of base 41. Sector gear 49 is joined to a handle 47 which is moved downwardly by the child user in the direction indicated by arrow 48. Shaft 51 further supports an accelerator arm 50 which extends downwardly in alignment with the center of the entrance portion of track loop 27. A helical support 52 is coupled to the opposite end of shaft 51 and allows arm 50 to progress laterally to maintain a centered relationship within loop 42 as it rotates. Thus, as toy vehicle 18 traveling in the direction indicated by arrow 19 along track loop 27 enters the entrance side of booster 40, the user attempts to time the downward plunge of handle 47 in the direction indicated by arrow 48 so as to rapidly accelerate arm 50 in the clockwise direction shown by arrow 46. When properly timed, the rapid clockwise rotation of arm 46 contacts the rear portion of vehicle 18 and accelerates it rapidly about loop 42. At the bottom end of loop 42, toy vehicle 18 now possessing considerable energy leaves arm 50 behind and travels upwardly upon track loop 27 toward lap counter 20.

The operation of the opposite side of booster 40 is carried forward in an identical manner as a toy vehicle travels upwardly on track loop 28 and enters loop 43. An arm 54 is supported by helix 52 at one end and a, gear and sector gear combination at the outer end. A handle 53 rotates the sector gear and rapidly accelerates arm 54 in the direction indicated by arrow 56. Once again, if this acceleration by the user in moving handle 43 downwardly is properly timed, arm 54 rapidly moves in a clockwise direction accelerating the toy vehicle and sending it upwardly from the booster at an increased speed.

Toy vehicle trackset 10 further includes a lap counter 20. Lap counter 20 functions to maintain a count for each transition of a toy vehicle traversing each of track loops 27 and 28. Lap counter 20 may be constructed in accordance with conventional fabrication techniques. Once a predetermined number of laps have been counted, lap counter 20 is activated in the manner described below in greater detail. Suffice it to note here that lap counter 20 among other operations diverts the toy vehicle having completed the predetermined number of laps onto a launch ramp such as launch ramp 30 or 31 to be directed toward target release 13. A player wins the game upon completing the number of laps and hitting the target.

Figure 3:
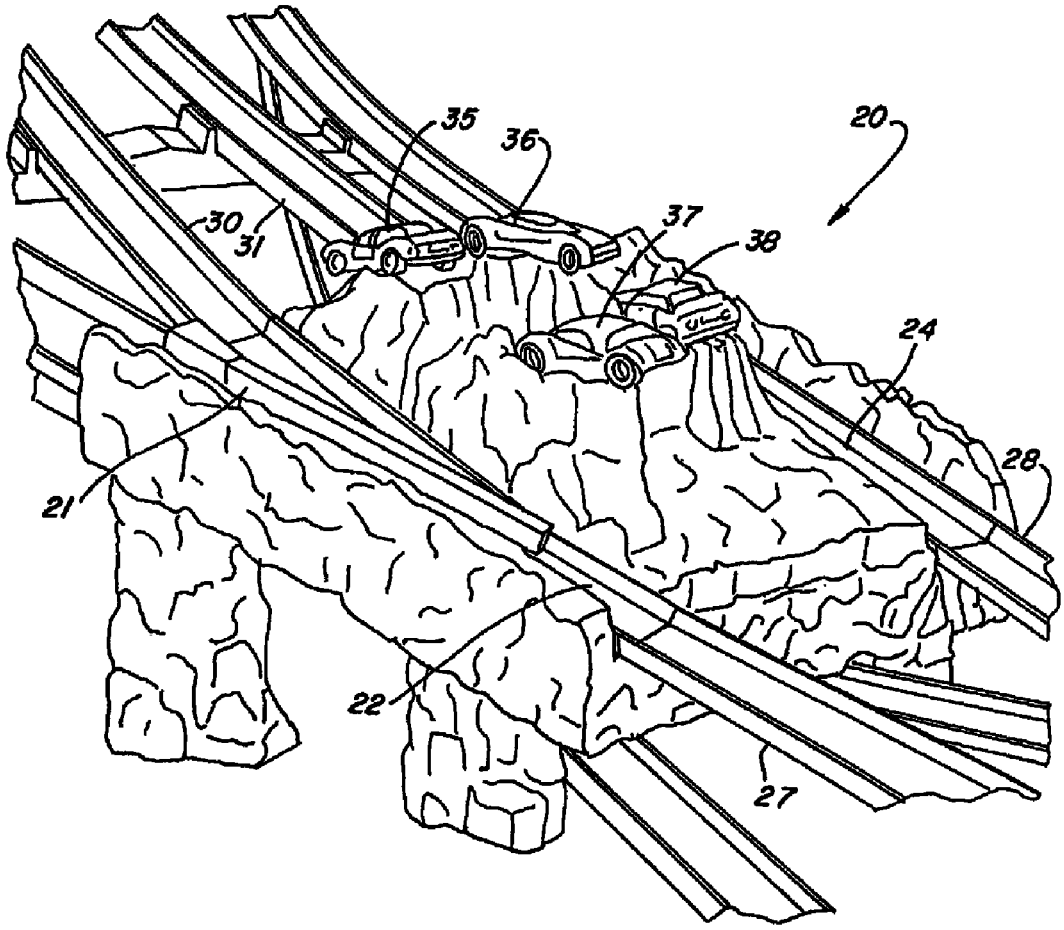
FIG. 3 sets forth a perspective view of the lap counter volcano of the present invention toy vehicle trackset.

With concurrent reference to FIGS. 1 and 3, lap counter 20 which is situated at the approximate midpoint of track loops 27 and 28 provides inclined paths for toy vehicles moving ascending upwardly toward rigid support 11 and descending downwardly therefrom to the lower end of each track loop. Lap counter 20 includes an ascent path 22 within track loop 27 and a downwardly angled decent path 23 also for track loop 27. Similarly, lap counter 20 includes an ascent path 24 and a descent path 25 for track loop 28. A plurality of toy vehicles 35 through 38 are situated upon launch positions formed on lap counter 20. Within lap counter 20, a pair of conventional flag-type lap counters are situated in the descent paths of the lap counter one for each of track loops 27 and 28 (not shown). Flag counters within lap counter 20 are conventional in fabrication. A diverter 21 is situated within ascent path 22 of lap counter 20 and is operative to divert a toy vehicle from ascent path 22 to launch path 30 rather than continuing on track loop 27. A similar diverter is operative upon the opposite side of lap counter 20 which is not visible due to the perspective view thereof but which will be understood to be generally identical to diverter 21. Thus, in response to a predetermined lap count, one or more of toy vehicles 35 through 38 are launched from lap counter 20 when a diverter such as diverter 21 is operative to switch the returning toy vehicle to a launch path. Launch ramps 30 and 31 extend upwardly from lap counter 20 and are each aimed at target release 13. Impact against target release 13 allows spring-loaded launcher 12 to launch flying dinosaur 16 in the direction indicated by arrow 15.

What has been shown is a multiply featured toy vehicle trackset in which the child user is able to interact manually and participate in the fortunes of the toy vehicle cars traversing the tracks. A dramatic launch of a dinosaur provides an exciting climax to the game.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. A toy vehicle trackset comprising:

a raised track support;

a pair of closed toy vehicle track loops each having a raised end supported by said raised track support and a lower end;

a dual loop booster having a pair of booster loops each having an offset entrance and exit track portion and a helical portion of one of said track loops passing therebetween and each booster loop having a helically supported acceleration arm operative to accelerate a toy vehicle passing through said booster loop, each acceleration arm moving laterally relative to the helical portion of its corresponding booster loop so that each acceleration arm maintains a substantially centered relationship within its booster loop as the acceleration arm is rotated relative to its booster loop;

a lap counter, interposed between said raised track support and said dual loop booster, having a pair of open-end launch ramps and a diverter that diverts a toy vehicle from one of said track loops to one of said launch ramps; and a target having a target element positioned in the path of a toy vehicle launched from either of said launch ramps.

2. The toy vehicle trackset set forth in claim 1 wherein said dual loop booster includes a pair of user-operated hand cranks each operatively coupled to one of said acceleration arms to rotate said arms against toy vehicles within said booster loops.

3. The toy vehicle trackset set forth in claim 1 wherein said target includes a spring-loaded toy figure launcher receiving a toy figure operatively coupled to said target element.

4. The toy vehicle trackset set forth in claim 3 wherein said toy figure launcher responds to impact against said target element from a toy vehicle launched from one of said launch ramps to launch said toy figure.

5. The toy vehicle trackset set forth in claim 1 wherein said lap counter activates said diverter when a predetermined number of laps have been counted.

6. The toy vehicle trackset set forth in claim 1, wherein each of the acceleration arms is rotatable in a circle as the acceleration arm is rotated to boost a toy vehicle in the corresponding toy vehicle track loop.

7. A toy vehicle trackset comprising:

a first closed-loop track loop having a first end;

a raised support supporting said first end in an elevated position;

a first booster operative to accelerate toy vehicles upon said first track loop, said booster including an entrance and exit track portion and an helical loop therebetween and a helically supported booster arm, the booster arm moving laterally relative to the helical loop so that the booster arm maintains a substantially centered relationship within the helical loop as the booster arm is rotated relative to the helical loop;

a lap counter operative to count laps traversed by toy vehicles upon said first track loop;

a first diverter responsive to said lap counter operative to divert toy vehicles from said first track loop;

a target; and a first launch ramp coupled to said diverter directed toward said target.

8. The toy vehicle trackset set forth in claim 7 further including a second closed-loop track loop, a second booster, a second diverter and a second launch ramp coupled to said second diverter and directed toward said target.

9. The toy vehicle trackset set forth in claim 7 wherein said target is supported by said raised support.

10. The toy vehicle trackset set forth in claim 7 wherein said raised support includes a spring-loaded toy launcher and a toy received within said launcher and launched therefrom when said target is impacted by a toy vehicle.

11. The toy vehicle trackset set forth in claim 10 wherein said toy is a gliding toy figure.

12. The toy vehicle trackset set forth in claim 7, wherein the booster arm is mounted for rotation about a horizontal axis, the booster arm progressing along the horizontal axis as the booster arm is rotated, the booster arm being rotatable in a full circle.

13. A toy vehicle trackset, comprising:

a closed toy vehicle track loop; and a booster coupled to the closed toy vehicle track loop, the booster being operative to accelerate a toy vehicle traveling within the track loop, the booster including a helical track loop having an entrance track portion and an exit track portion offset from the entrance track portion, the helical track loop having a helically supported acceleration arm that moves laterally relative to the helical track loop so that the acceleration arm follows the helical track loop as the acceleration arm is rotated.

14. The toy vehicle trackset set forth in claim 13, wherein the closed toy vehicle track loop is a first closed toy vehicle track loop and the acceleration arm is a first acceleration arm, the trackset further comprising:

a second closed toy vehicle track loop; and a second booster coupled to the second closed toy vehicle track loop, the second booster including a second helical track loop with a second acceleration arm that moves laterally relative to the second helical track loop so that the second acceleration arm follows the second helical track loop as the second acceleration arm is rotated, the first acceleration arm and the second acceleration arm moving laterally away from each other as the acceleration arms are rotated to boost toy vehicles on the closed toy vehicle track loops.

15. The toy vehicle trackset set forth in claim 14, wherein the acceleration arms are rotatably mounted on a common shaft and the acceleration arms move along the common shaft as the acceleration arms are rotated to boost toy vehicles.

16. The toy vehicle trackset set forth in claim 14, wherein the acceleration arms are mounted for rotation about a horizontal axis, the acceleration arms progressing along the horizontal axis as the acceleration arms are rotated.

17. The toy vehicle trackset set forth in claim 14 wherein each booster includes a user-operated hand crank operatively coupled to its acceleration arm to move its acceleration arm against a toy vehicle within its helical track loop.

18. The toy vehicle trackset set forth in claim 13, wherein the acceleration arm is mounted for rotation about a horizontal axis, the acceleration arm progressing along the horizontal axis as the acceleration arm is rotated.

19. The toy vehicle trackset set forth in claim 13, further comprising:

a toy figure launcher having a launching mechanism and a target responsive to an impact of a toy vehicle to release the launching mechanism;

a toy figure constructed to be supported by and launched by the launching mechanism;

a lap counter for counting laps completed by toy vehicles traveling within the closed toy vehicle track loop; and a diverter responsive to the lap counter to divert toy vehicles from the closed toy vehicle track loop toward the target.

20. The toy vehicle trackset set forth in claim 19 wherein the closed toy vehicle track loop has a raised end that is supported by said toy figure launcher.

* * * * *